United States Patent [19]

Hayashi et al.

[11] 4,367,272

[45] Jan. 4, 1983

[54] PHOTOGRAPHIC PRINTS BY COLOR DIFFUSION TRANSFER PROCESS

[75] Inventors: Hiroshi Hayashi; Tsutomu Hamaoka; Masakazu Morigaki, all of Minami-ashigara, Japan

[73] Assignee: Fuji Photo Film Co., Ltd, Kanagawa, Japan

[21] Appl. No.: 258,491

[22] Filed: Apr. 28, 1981

[30] Foreign Application Priority Data

Apr. 28, 1980 [JP] Japan ..... 55/56428

[51] Int. Cl.[3] ..... G03C 1/40

[52] U.S. Cl. ..... 430/17; 430/213; 430/216; 430/220; 430/372; 430/518; 430/941

[58] Field of Search ..... 430/17, 216, 217, 220, 430/372, 551, 213, 518, 941

[56] References Cited

U.S. PATENT DOCUMENTS

| | | | |
|---|---|---|---|
| 3,432,300 | 3/1969 | Lestina et al. | 430/551 |
| 4,148,648 | 4/1979 | Pfingston | 430/220 |
| 4,266,020 | 5/1981 | Sakai et al. | 430/216 |
| 4,286,042 | 8/1981 | Sakai et al. | 430/216 |

OTHER PUBLICATIONS

Research Disclosure, No. 15162, Nov. 1976, pp. 75–87.

*Primary Examiner*—J. Travis Brown

*Attorney, Agent, or Firm*—Sughrue, Mion, Zinn, Macpeak and Seas

[57] ABSTRACT

A photographic print prepared by a color diffusion transfer process comprising at least a support, a mordant layer containing therein a diffusion transfer dye image, and a white reflection layer constituting the background of the dye image and containing therein at least one compound represented by formula (I):

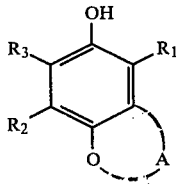

(I)

wherein $R_1$, $R_2$ and $R_3$ may be the same or different and each represents a hydrogen atom, a halogen atom, an alkyl group, an aryl group, an aralkyl group, an alkoxy group, an aryloxy group, an aralkyloxy group, an alkenyl group, an alkenyloxy group, an alkylthio group, an arylthio group, an acyl group, an acylamino group, a diacylamino group, an alkylamino group, a sulfonamido group, an acyloxy group, an alkoxycarbonyl group, or an aryloxycarbonyl group, and A represents a non-metallic atom group necessary for forming a 5- or 6-membered ring.

13 Claims, No Drawings

PHOTOGRAPHIC PRINTS BY COLOR DIFFUSION TRANSFER PROCESS

FIELD OF THE INVENTION

This invention relates to a photographic print formed by a color diffusion transfer process. More particularly, it relates to a photographic print in which a color image formed in a color diffusion transfer photographic element has increased stability against light (hereinafter referred to as "light-resistance").

BACKGROUND OF THE INVENTION

In order to improve the light-resistance of a color image in the color diffusion transfer photographic system, a number of studies on the use of various discoloration-preventing agents have heretofore been made. For example, incorporation of various discoloration-preventing agents into a mordant layer of the color diffusion transfer photographic system is disclosed in *Research Disclosure,* No. 15162, page 81, left column, line 20 from the bottom to page 82, left column, line 8 (Nov. 1976).

However, when such discoloration-preventing agents are added to a mordant layer (in which an image is formed), for example, by a method as disclosed in U.S. Pat. No. 3,432,300, various problems arise. For example, the density of the color diffusion transfer photographic print obtained decreases. Accordingly, the high quality of the photographic print cannot be maintained.

Furthermore, when materials to be incorporated into an image-receiving layer and a method for use in such incorporation are limited in an attempt to eliminate the foregoing problems, the original object, i.e., improvement in the light-resistance of a photographic print, cannot always be satisfactorily attained.

The foregoing reference, *Research Disclosure,* No. 15162 also discloses in page 82, left column, lines 9 to 6 from the bottom that light-resistance can be improved by adding tert-butylhydroxy anisole as a discoloration-preventing agent to a white reflection layer of the color diffusion transfer photographic system. In accordance with this method, however, the improvement in the light-resistance is not sufficient. Furthermore, when the photographic print is exposed to light for long periods of time, it turns yellow-brown, significantly staining the white ground thereof.

Japanese Patent Application (OPI) No. 159225/79 (the term "OPI" as used herein refers to a "published unexamined Japanese patent application") discloses that for the purpose of improving the light-resistance, phenol-based antioxidants, such as bisphenols, are incorporated into a white reflection layer. However, even when using this method it is desirable to greatly improve the light-resistance, even though the method greatly improves defects of the prior art method.

Conventional white pigments for use in a white reflection layer are undesirable because they deteriorate the light-resistance of a diffusion transfer color image. It is believed that this occurs because white pigments, such as titanium oxide, themselves have optical activity. Accordingly, they exert adverse influences on the light-resistance of the transferred color image. In order to remove the problem caused by the optical activity, almost all of titanium oxides on the market are coated with at least one substance of aluminum oxide, silicon oxide and zinc oxide depending on the particular application. However, even though surface-coated titanium oxide is used as a material for a white reflection layer for the color diffusion transfer process, sufficiently satisfactory light-resistance has not been obtained. It is, therefore, important to incorporate an effective discoloration-preventing agent into the white reflection layer.

SUMMARY OF THE INVENTION

An object of this invention is to provide a photographic print formed by the color diffusion transfer process, which is free from the foregoing defects of the prior art.

Another object of this invention is to provide a photographic print formed by a color diffusion transfer process, which includes a white reflection layer containing a discoloration-preventing agent having a great discoloration-preventing effect which is durable over a long period of time.

These objects can be attained by incorporating a novel discoloration-preventing agent into a white reflection layer.

This invention, therefore, provides a photographic print formed by a color diffusion transfer process. The print is comprised of: a support, a mordant layer (i.e., an image-receiving layer) containing a diffusion transferred dye image, and a white reflection layer constituting the background of the dye image. The white reflection layer contains at least one compound represented by formula (I):

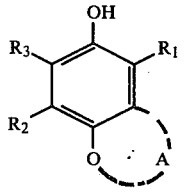

(I)

wherein $R_1$, $R_2$ and $R_3$ may be the same or different and each represents a hydrogen atom, a halogen atom, an alkyl group, an aryl group, an aralkyl group, an alkoxy group, an aryloxy group, an aralkyloxy group, an alkenyl group, an alkenyloxy group, an alkylthio group, an arylthio group, an acyl group, an acylamino group, a diacylamino group, an alkylamino group, a sulfonamido group, an acyloxy group, an alkoxycarbonyl group, or an aryloxycarbonyl group, and A represents a non-metallic atom group necessary for forming a 5- or 6-membered ring.

DETAILED DESCRIPTION OF THE INVENTION

Compounds represented by formula (I) are described in greater detail.

In formula (I), $R_1$, $R_2$ and $R_3$ may be the same or different and each represents a hydrogen atom, a halogen atom (e.g., a chlorine atom), a branched-chain, straight-chain or cyclic alkyl group containing 1 to 20 carbon atoms (e.g., a methyl group, a tert-butyl group, a cyclopentyl group, a cyclohexyl group, an octyl group, a dodecyl group, and an octadecyl group), an aryl group (e.g., a phenyl group, a p-methylphenyl group, a p-methoxyphenyl group, a p-octadecanamidophenyl group, an o-chlorophenyl group, an o-methylphenyl group, an m-nitrophenyl group, and an α-naphthyl group), an aralkyl group (e.g., a benzyl group and a phenethyl group), a branched-chain, straight-chain or cyclic alkoxy group containing 1 to 20 carbon atoms (e.g., a methoxy group, a tert-butoxy group, a cyclohexyloxy group, a dodecyloxy group, and an octadecyloxy group), an aryloxy group (e.g., a phenoxy group, an α-naphthoxy group, a p-methylphenoxy group, a p-methoxyphenoxy group, a p-caproamidophenoxy group, an o-chlorophenoxy group, and an m-nitrophenoxy group), an aralkyloxy group (e.g., a benzyloxy group and a phenethyloxy group), an alkenyl group (e.g., an allyl group), an alkenyloxy group (e.g., an allyloxy group), a branched-chain, straight-chain or cyclic alkylthio group containing 1 to 20 carbon atoms (e.g., a methylthio group, a tert-butylthio group, a hexylthio group, a cyclohexylthio group and an octadecylthio group), an arylthio group (e.g., a phenylthio group a p-methylphenylthio group, an o-carboxyphenylthio group, an o-methylphenylthio group, an o-methoxycarbophenylthio group, and an m-nitrophenylthio group), an acyl group containing 1 to 20 carbon atoms (e.g., an acetyl group, a capryl group, and a p-methoxybenzoyl group), an acylamino group (e.g., an acetylamino group, a benxoylamino group, and a caproamido group), a diacylamino group (e.g., a succinimido group, a hydantoinyl group), a branched-chain or straight-chain alkylamino group containing 1 to 20 carbon atoms (e.g., an ethylamino group, a tert-butylamino group, a dioctylamino group, and an octadecylamino group), a sulfonamido group, an acyloxy group containing 1 to 20 carbon atoms (e.g., an acetoxy group, a caproxy group, a lauroxy group, and a benzoyloxy group), a branched-chain or straight-chain alkoxycarbonyl group containing 2 to 21 carbon atoms (e.g., a methoxycarbonyl group, a tert-butoxycarbonyl group, and an octadecyloxycarbonyl group), and an aryloxycarbonyl group (e.g., a phenoxycarbonyl group, a p-methoxyphenoxycarbonyl group, a p-acetamidophenoxycarbonyl group, and an o-chlorophenoxycarbonyl group).

A represents a non-metallic atom group necessary for forming a 5- or 6-membered ring. Examples of such non-metallic atoms are a carbon atom, a nitrogen atom, an oxygen atom, a sulfur atom, etc.

The 5- or 6-membered ring formed by the non-metallic atom group may be substituted by an alkyl group (e.g., a methyl group, a tert-butyl group, a cyclohexyl group, an octyl group, a dodecyl group, and an octadecyl group), an alkoxy group (e.g., a methoxy group, a tert-butoxy group, a cyclohexyloxy group, and a deodecyloxy group), an aryl group (e.g., a phenyl group and a naphthyl group), an aryloxy group (e.g., a phenoxy group), an aralkyl group (e.g., a benzyl group and a phenethyl group), an aralkyloxy group (e.g., a benzyloxy group and a phenethyloxy group), an alkenyl group (e.g., an allyl group), an alkenyloxy group (e.g., an allyloxy group), an N-substituted amino group (e.g., an alkylamino group, a dialkylamino group, an N-alkyl-N-arylamino group, a piperazino group, a pyrrolidino group, and a morpholino group), a heterocyclic ring group bonded through a carbon atom contained in the heterocyclic ring (e.g., a benzothiazolyl group, a benzoxazolyl group, an imidazolyl group, and an oxazolyl group), etc. Furthermore, a carbon ring (e.g., a 5- or 6-membered ring) may be condensed to the foregoing 5- or 6-membered ring.

The alkyl group and aryl group (including the alkyl and aryl portions contained in substituents) described with respect to $R_1$ to $R_3$ and A may be substituted by a halogen atom, a hydroxy group, a carboxy group, an alkoxycarbonyl group, an acyloxy group, a sulfo group, a sulfonyloxy group, an amido group (e.g., an acetamido group, an octadecanamido group, a caproamido group, an ethanesulfonamido group, and a benzamido group), an alkoxy group, an aryloxy group, or the like. Additional substituents for the aryl group (or the aryl portion) include a nitro group and an alkyl group.

These compounds, represented by formula (I), are preferably non-diffusible. These compounds are preferably water-insoluble. It is, therefore, preferred that they contain a group which makes them non-diffusible (so-called "ballast group"). These ballast groups are well known in the field of dye-releasing redox compounds as described hereinafter.

Of the compounds represented by formula (I), the compounds represented by formulae (II) and (III) below are particularly effective.

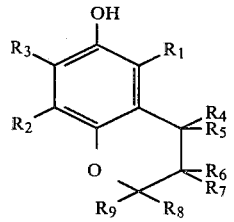

(II)

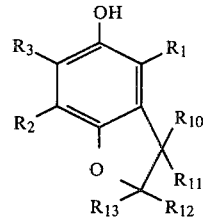

(III)

In formulae (II) and (III), $R_1$, $R_2$ and $R_3$ are the same as described for formula (I). $R_1$ and $R_2$ are preferably a methyl group or a hydrogen atom. $R_3$ is preferably a straight-chain, branched-chain or cyclic alkyl group containing 1 to 20 carbon atoms (e.g., a methyl group, an ethyl group, a tert-butyl group, a tert-octyl group, a cyclohexyl group), a straight-chain, branched-chain or cyclic alkoxy group containing 1 to 5 carbon atoms (e.g., a methoxy group, an ethoxy group, a tert-butoxy group) or a straight-chain, branched-chain or cyclic alkylthio group containing 1 to 15 carbon atoms (e.g., a methylthio group, a dodecylthio group), and most preferably a straight-chain, branched-chain or cyclic alkyl group containing 1 to 20 carbon atoms.

$R_4$ to $R_{13}$ may be the same or different and each represents a hydrogen atom, a halogen atom (e.g., a chlorine atom), a branched-chain, straight-chain or cyclic alkyl group containing 1 to 20 carbon atoms (e.g., a methyl group, a tert-butyl group, a cyclohexyl group, an octyl group, and an octadecyl group), a branched-chain, straight-chain or cyclic alkoxy group containing 1 to 20 carbon atoms (e.g., a methoxy group, a tert-butoxy group, a cyclohexyloxy group, and an octadecyloxy group), a branched-chain, straight-chain or cyclic alkylthio group containing 1 to 20 carbon atoms (e.g., a methylthio group, a tert-butylthio group, a cyclohexylthio group, and an octadecylthio group), an alkenyl group (e.g., an allyl group), an alkenyloxy group (e.g., an allyloxy group), an aryl group (e.g., a phenyl group, a p-methylphenyl group, a p-methoxyphenyl group, a p-octadecanamidophenyl group, an o-chlorophenyl group, an o-methylphenyl group, an m-nitrophenyl group, and an α-naphthyl group), an aryloxy group (e.g., a phenoxy group, an α-naphthoxy group, a p-methylphenoxy group, a p-methoxyphenoxy group, a p-caproamidophenoxy group, an o-chlorophenoxy group, and an m-nitrophenoxy group), an N-substituted amino group (e.g., an alkylamino group, a dialkylamino group, an N-alkyl-N-arylamino group, a piperazino group, a pyrrolidino group, and a morpholino group), or a heterocyclic ring group bonded through a carbon atom contained in the heterocyclic ring (e.g., a benzothiazolyl group, a benzoxazolyl group, an imidazolyl group, and an oxazolyl group).

$R_8$ and $R_9$, or $R_{10}$ and $R_{12}$ may combine together to form a 5- or 6-membered ring which may be substituted.

The alkyl group (including the alkyl portion) and the aryl group (including the aryl portion) described with respect to $R_4$ to $R_{13}$ may be substituted. Substituents which can be used are the same as described with respect to $R_1$ to $R_3$ and A.

Of the compounds represented by formula (II), those compounds wherein $R_1$, $R_2$, and $R_4$ to $R_8$ are methyl or hydrogen are particularly preferred.

Representative examples of these compounds are shown below although this invention is not limited thereto.

(1)

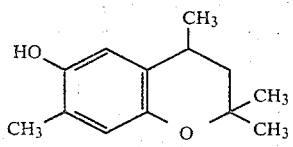

(2)

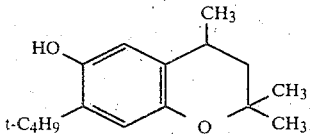

(3)

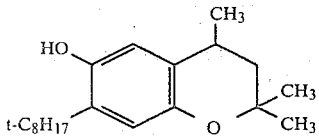

(4)

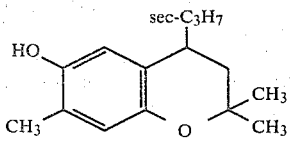

(5)

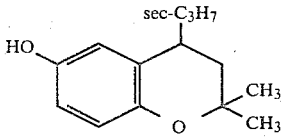

(6)

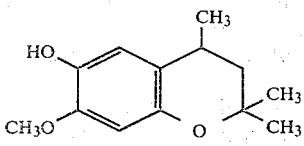

-continued (7)

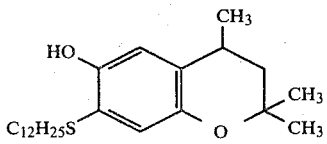

(8)

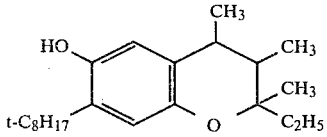

(9)

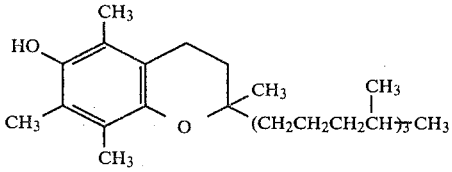

(10)

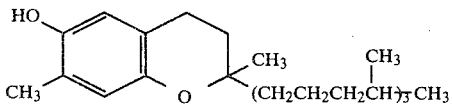

(11)

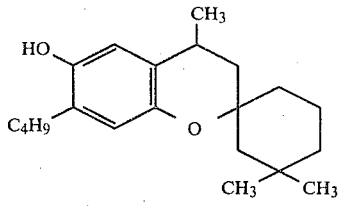

(12)

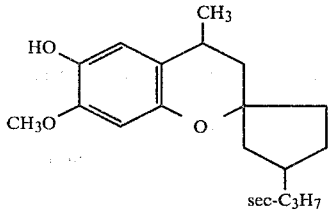

(13)

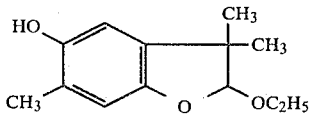

(14)

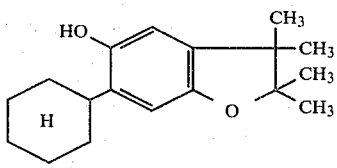

(15)

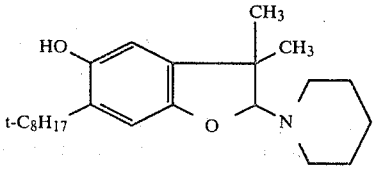

-continued (16)

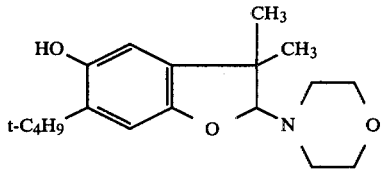

(17)

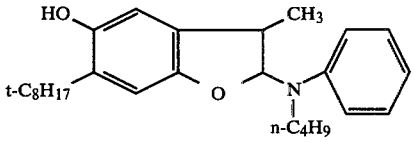

(18)

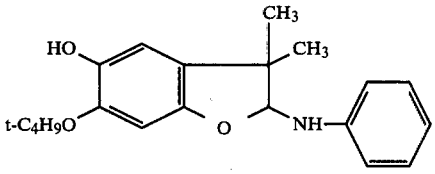

(19)

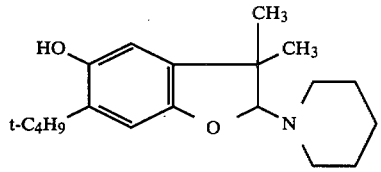

(20)

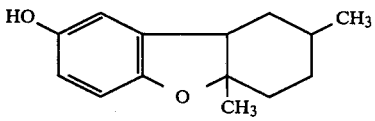

These compounds are described in U.S. Pat. No. 3,432,300, Japanese Patent Publication Nos. 6208/74, 8338/74 and 12514/78, and Japanese Patent Application (OPI) Nos. 68569/76, 149263/76, 14771/77 and 14772/77, or are synthesized by the methods described therein.

The following are typical photographic light-sensitive element for obtaining the photographic print of this invention.

(1) A so-called "integral type" of light-sensitive element wherein (i) a light-sensitive sheet comprises a transparent support and an image-receiving layer, a white reflection layer (containing the discoloration-preventing agent of this invention), a light-shielding layer containing carbon black, a layer containing a cyan dye image-forming compound, a red-sensitive silver halide emulsion layer, an intermediate layer, a layer containing a magenta dye-forming compound, a green-sensitive silver halide emulsion layer, an intermediate layer, a layer containing a yellow dye image-forming compound, a blue-sensitive silver halide emulsion layer, and a protective layer provided on the support in that sequence; (ii) a cover sheet comprises a transparent support and a neutralizing layer and a timing layer provided on the support; (iii) the light-sensitive sheet and the cover sheet are superposed in face-face relation; (iv) a pressure-rupturable container containing therein a carbon black-containing processing solution is placed between the light-sensitive sheet and the cover sheet in such a manner that the processing solution extends therebetween; and (v) the light-sensitive sheet, the cover sheet and the pressure-rupturable container are combined together and fixed.

A film unit construction, as described above (except for the discoloration-preventing agent of this invention which is incorporated into the white reflection layer), has been known and is described in detail, for example, in *Photographic Science and Engineering,* Vol. 20, No. 4, pages 155 to 164 (July/August, 1976). Furthermore, the reaction mechanism in which a transferred image is obtained is described in detail in the foregoing reference.

(2) A so-called "integral type" of light-sensitive element wherein (i) an image-receiving sheet comprises a transparent support and a neutralizing layer, a timing layer and an image-receiving layer provided on the support; (ii) a light-sensitive sheet comprises an opaque support and a layer containing a cyan dye image-forming compound, a red-sensitive silver halide emulsion layer, an intermediate layer, a layer containing a magenta dye image-forming compound, a green-sensitive silver halide emulsion layer, an intermediate layer, a layer containing a yellow dye image-forming compound, a blue-sensitive silver halide emulsion layer, and a protective layer provided on the support in that sequence, (iii) the image-receiving sheet and the light-sensitive sheet are superposed in face-face relation; (iv) a pressure-rupturable container containing therein a processing solution, which contains a plurality of pH indicator dyes, a discoloration-preventing agent of this invention, and a white pigment for a white reflection layer, is placed between the image-receiving sheet and the light-sensitive sheet in such a manner that the processing solution extends therebetween; and (v) the image-receiving sheet, light-sensitive sheet and pressure-rupturable container are combined together and fixed.

A film unit construction, as described above (except for the discoloration-preventing agent of this invention which is used in the processing solution), has been known and is described in detail, for example, in *Neblettes Handbook of Photography and Reprography Materials, Processes and Systems,* 7th Ed., Chapter 12 (1977). Furthermore, the reaction mechanism in which a transferred image is obtained is described in detail in the foregoing reference. The foregoing pH indicator dyes are described in detail, for example, in U.S. Pat. Nos. 3,647,437 and 3,833,615.

The layer construction of each of the foregoing light-sensitive elements (1) and (2) can be changed, if desired. For example, the dye image-forming compound and silver halide may be present in the same layer. The timing layer may be composed of a plurality of layers. Furthermore, the light-sensitive sheet and image-receiving sheet may be such that they can be removed from each other.

The photographic print of this invention is preferably prepared using the integral type of light-sensitive element as described above, i.e., an integral type of photographic print.

The white reflection layer of the present photographic print may be either a layer previously provided or a layer formed by the processing solution. In brief, the white reflection layer is provided to give a white color to a non-image area. Accordingly, an image formed in the color diffusion transfer photographic system can be seen with a reflection light. The white reflection layer contains a pigment for giving a white color.

White pigments which can be used in the white reflection layer include barium sulfate, zinc oxide, barium stearate, silver flake, silicates, alumina, zirconium oxide, zirconium, sodium sulfate, kaolin, mica, and titanium dioxide. These compounds can be used alone or in combination with each other in order to obtain a desirable reflectance. Of the foregoing pigments, titanium dioxide is particularly useful.

The whiteness of the white reflection layer varies depending on the type of pigment, the ratio of pigment to binder, and the amount of pigment coated, but it is preferred that the light reflectance is about 70% or more. In general, as the amount of pigment coated is increased, the whiteness is increased. It is desirable, however, that the amount of pigment coated is controlled at a suitable level because when an image-forming dye diffuses through the white reflection layer, the pigment inhibits the diffusion.

Titanium dioxide is coated in an amount of from about 5 to 40 $g/m^2$, preferably from about 10 to 25 $g/m^2$, to provide a white reflection layer having a light reflectance of from about 78 to 85% to light having a wavelength of 540 nm.

The titanium dioxide used can be selected from those available on the market. In particular, it is preferred to use a rutile type of titanium dioxide. Many of titanium dioxides on the market are subjected to surface treatment using alumina, silica, zinc oxide or the like. In order to obtain a high reflectance, it is desirable to use those titanium dioxides containing surface-treatment agents in an amount of about 5% or more. Examples of such titanium dioxides on the market include Ti-pure R931 (produced by E. I. Du Pont Co.) and those disclosed in *Research Disclosure,* No. 15162.

Binders which can be used in the white reflection layer include alkali-permeable polymeric matrixes, such as gelatin, polyvinyl alcohol, and cellulose derivatives (e.g., hydroxyethyl cellulose and carboxymethyl cellulose).

A particularly preferred binder for use in the white reflection layer is gelatin. The ratio of pigment to gelatin is from about 1/1 to 20/1 (by weight) and preferably about 5/1 to 10/1 (by weight).

Anionic dispersants are particularly useful in dispersing the white pigment in the white reflection layer. Dispersants which can be used include Dispersants (1) to (4) shown below and those disclosed in *Research Disclosure,* No. 15162.

Dispersant (1) Aerosol OT (produced by American Cyanamide Co.)

Dispersant (2) Tamol 850 (produced by Rohm & Haas Co.)

Dispersant (3) Demol N (produced by Kao Soap Co., Ltd.)

Dispersant (4) Alkanol XC (produced by Du Pont Co.)

A particularly preferred dispersant is a condensate of formaldehyde and naphthalinsulfonic acid, such as Tamol 850. These dispersants can be used alone or in combination with each other.

Additionally, phosphoric acid alkali metal salts, such as sodium hexametaphosphate, and cellulose derivatives, such as hydroxyethyl cellulose and carboxymethyl cellulose, can be used as useful dispersants.

In producing the white reflection layer, the white pigment is added to an aqueous solution containing a dispersant and then dispersed therein. The thus-obtained dispersion is then mixed with a binder, such as gelatin.

Furthermore, in order to improve the whiteness of the white reflection layer, fluorescent brighteners, such as stilbene-based, cumarin-based, triazine-based, and oxazole-based fluorescent brighteners, can be incorporated into the white reflection layer. Moreover, in order to decrease the brittleness of the white reflection layer, polymer latexes can be incorporated into the white reflection layer. Examples of such polymer latexes are disclosed in *Research Disclosure,* No. 15162, page 82, left column, line 3 from the bottom to right column, line 1 (November, 1976).

Examples of useful fluorescent brighteners are described in *Research Disclosure,* Vol. 176, No. 17643, page 24, left column, lines 9 to 36 (December, 1978) (under the title of Brighteners), U.S. Pat. Nos. 2,632,701, 3,269,840, and 3,359,102, British Pat. Nos. 852,075 and 1,319,763, etc.

The white reflection layer is prepared by adding a surfactant (auxiliary coating agent), a hardener, a tackifier, etc., to the pigment dispersion, and coating the resulting mixture by a conventional coating method.

The discoloration-preventing agent of this invention can be incorporated into the white reflection layer by various known methods. Useful methods include a method in which the discoloration-preventing agent is dissolved in a low boiling point organic solvent, such as ethanol, acetone and tetrahydrofuran, and added to the white pigment dispersion; a method in which the discoloration-preventing agent is dissolved in diethyllaurylamide, N-n-butylacetanilide, dibutyllaurylamide, tricresyl phosphate, or oil, such as triglyceride of higher aliphatic acid, and then emulsified and dispersed in gelatin, and the resulting dispersion is added to the white pigment dispersion. Another method is disclosed in Japanese Patent Application (OPI) No. 59943/76, in which the discoloration-preventing agent is dissolved in organic polymer latex particles and then added to the white pigment dispersion. In still another method, the discoloration-preventing agent is an oil or oily substance which is mixed directly with the white pigment dispersion, and emulsified and dispersed therein.

The optimum amount of the discoloration-preventing agent of this invention added to the white reflection layer is from about 0.05 to 3.0 $g/m^2$ and preferably from about 0.15 to 1.2 $g/m^2$. However, the amount varies depending on the type of the discoloration-preventing agent. When amount used is less than 0.05 $g/m^2$, the effect of the invention in improving light resistance is significantly small. When amounts above 3.0 $g/m^2$ are used, the discoloration-preventing agent prevents the image-forming dye from diffusing into the white reflection layer. This retards the completeness of an image and markedly deteriorates photographic characteristics.

The mordant layer as used herein is preferably a hydrophilic colloid layer containing therein a polymer mordant.

Polymer mordants which can be used in this invention include polymers containing a secondary or tertiary amino group, polymers containing a nitrogen-containing heterocyclic portion, and polymers containing a quaternary cationic group. Useful polymer mordants have a molecular weight of from about 5,000 to 200,000, preferably from about 10,000 to 50,000.

Examples of such polymer mordants include a vinyl pyridine polymer and a vinyl pyridinium cation polymer as described in U.S. Pat. Nos. 2,548,564, 2,484,430, 3,148,061 and 3,756,814; a polymer mordant which can be cross-linked together with gelatin, etc., as described in U.S. Pat. Nos. 3,625,694, 3,859,096 and 4,128,538, and British Pat. No. 1,277,453; an aqueous sol-type mordant as described in U.S. Pat. Nos. 3,958,995, 2,721,852 and 2,798,063, and Japanese Patent Application (OPI) Nos. 115228/79, 145529/79 and 126027/79; a water-insoluble mordant as described in U.S. Pat. No. 3,898,088; a reactive mordant capable of undergoing covalent bonding with dye as described in U.S. Pat. No. 4,168,976 (corresponding to Japanese Patent Application (OPI) No. 137333/79); and mordants as described in U.S. Pat. Nos. 3,709,690, 3,788,855, 3,642,482, 3,488,706, 3,557,066, 3,271,147, 3,271,148, Japanese Patent Application (OPI) Nos. 71332/75, 30328/78, 155528/77, 125/78 and 1024/78.

Of these mordants, it is preferable to use those which remain substantially within a single layer, i.e., have difficulty moving from the mordant layer to another layer. For example, it is preferable to use those mordants capable of undergoing cross-linking with a matrix such as gelatin, water-insoluble mordants, and aqueous sol- or latex dispersion-type mordants.

Particularly preferred polymer mordants are as follows:

(1) Polymers containing a quaternary ammonium group and a group capable of undergoing cross-linking with gelatin (e.g., an aldehyde group, a chloroalkanoyl group, a chloroalkyl group, a vinylsulfonyl group, a pyridiniumpropionyl group, a vinylcarbonyl group, and an alkylsulonoxy group), such as those polymers represented by the following formula:

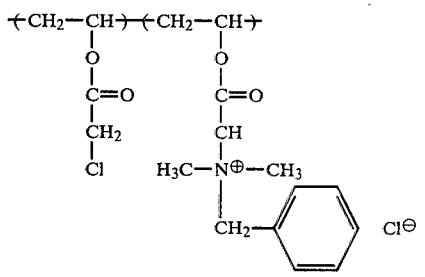

(2) Reaction products of copolymers comprising a repeating unit represented by the formula shown below and a repeating unit of an ethylenically unsaturated monomer, and cross-linking agents (e.g., bisalkane sulfonate and bisallene sulfonate).

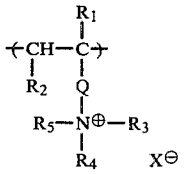

wherein $R_1$ is a hydrogen atom or an alkyl group; $R_2$ is a hydrogen atom, an alkyl group, or an aryl group; Q is a divalent group; $R_3$, $R_4$ and $R_5$ are each an alkyl group, or an aryl group, and at least two of $R_3$, $R_4$ and $R_5$ may combine together to form a heterocyclic ring; and X is an anion. These group and ring may be substituted. (3) Polymers represented by the following formula:

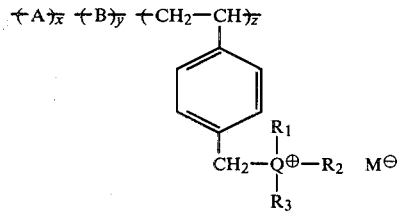

wherein x is from about 0.25 to 5 mol%; y is from about 0 to 90 mol%; z is from about 10 to 99 mol%; A is a monomer containing therein at least two ethylenically unsaturated bonds; B is a copolymerizable ethylenically unsaturated monomer; Q is N or P; $R_1$, $R_2$ and $R_3$ are each an alkyl group or a cyclic hydrocarbon group, and at least two or $R_1$, $R_2$ and $R_3$ may combine together to form a ring. These group and ring may be substituted.

(4) Polymers comprising the following (a), (b) and (c):

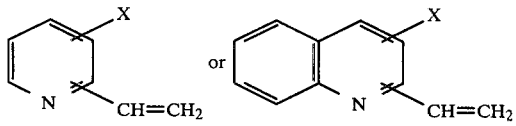

(a)

wherein X is a hydrogen atom, an alkyl group which may be substituted, or a halogen atom.

(b) acrylic acid ester (c) acrylonitrile (5) Water-insoluble homopolymers comprising a repeating unit represented by the formula shown below, and water-insoluble copolymers, one-third or more of which comprises the repeating unit:

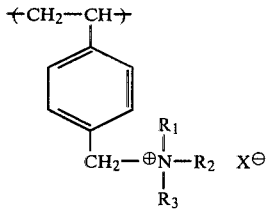

wherein $R_1$, $R_2$ and $R_3$ are each an alkyl group which may be substituted, and the total number of carbon atoms contained in $R_1$, $R_2$ and $R_3$ is 12 or more; and X is an anion. Examples of such copolymers are described in U.S. Pat. No. 3,898,088.

The foregoing water-insoluble homo- and copolymers, those described under (5), are particularly preferred to be used in this invention.

Various known gelatins can be used in the mordant layer. For example, lime-treated gelatin, acid-treated gelatin, etc., prepared by different methods of production, and chemical modification products of such gelatins, such as phthalated gelatin and sulfonylated gelatin can be used. If desired, they may be subjected to desalting treatment.

The ratio of polymer mordant to gelatin and the amount of the polymer mordant coated can be easily determined by one skilled in the art depending on the amount of the dye to be mordanted, the type and composition of the polymer mordant and furthermore on the image-forming process used. Preferably, the ratio of mordant to gelatin is from about 20/80 to 80/20 (by weight) and the amount of the mordant coated is from about 0.5 to 8 g/m$^2$.

Other materials may be added to the mordant layer for use in this invention. Examples of such materials include a discoloration-preventing agent and an ultraviolet ray absorber for the purpose of improving the light resistance, and additives such as the foregoing fluorescent brightener for the purpose of increasing the whiteness.

Discoloration-preventing agents which can be used include hindered phenols, such as 2,6-di-tert-butyl-4-methylphenol, 2,2'-butylidene-bis(6-tert-butyl-4-methylphenol), and 4,4'-thiobis(3-methyl-6-tert-butylphenol), phenyl-$\beta$-naphthylamine, N,N'-di-sec-butyl-p-phenylenediamine, phenothiazine, and N,N'-diphenyl-p-phenylenediamine, as well as the discoloration-preventing agents of this invention.

The support used in this invention should not be subject to significant changes in dimension during the course of development. Examples of such supports which can be used include a cellulose acetate film, a polystyrene film, a polyester film (e.g., a polyethylene terephthalate film) and a polycarbonate film, which are used in usual photographic light-sensitive element.

The silver halide emulsion used in preparing the photographic print of this invention is a hydrophilic colloid dispersion of silver chloride, silver bromide, silver chlorobromide, silver iodobromide, silver chloroiodobromide or a mixture thereof. Of these compounds, silver bromide, silver iodobromide and silver chloroiodobromide, having an iodide content of about 10 mol% or less, and a chloride content of about 30 mol% or less, are particularly preferred. The silver halide emulsion may be the surface latent image type or the internal latent image type.

Silver halide emulsions of the internal latent image type include a conversion type emulsion, a core/shell type emulsion, and an emulsion containing therein a different metal, as described in, for example, U.S. Pat. Nos. 2,592,250, 3,206,313, 3,447,927, 3,761,276, and 3,935,014.

Typical examples of nucleus-forming agents which can be used in forming a direct positive image by the use of the emulsion of the foregoing internal latent image type include hydrazines described in U.S. Pat. Nos. 2,588,982 and 2,563,785; hydrazides and hydrazones described in U.S. Pat. Nos. 3,227,552; quaternary salt compounds described in British Pat. No. 1,283,835, Japanese Patent Publication No. 38164/74, U.S. Pat. Nos. 3,734,738, 3,719,494, and 3,615,615; sensitizing dyes containing a nucleating substituent in the dye molecule, described in U.S. Pat. No. 3,718,470; and acylhydrazinodiphenylthiourea compounds described in U.S. Pat. Nos. 4,030,925 and 4,031,127.

The silver halide emulsion can be treated with a spectral sensitizing dye to obtain extended color sensitivity. Spectral sensitizing dyes include cyanine dye and merocyanine dye.

Various compounds can be used as a dye image-forming compound for use in preparing the photographic print of this invention. Of these compounds, a dye-releasing redox compound and a dye developing agent are particularly useful.

Of such dye-releasing redox compounds, those compounds in which an oxidized compound is hydrolyzed by an alkali to release a dye are described, for example, in U.S. Pat. Nos. 4,053,312, 4,055,428, 4,076,529, 4,152,153 and 4,135,929; Japanese Patent Application (OPI) Nos. 149328/78, 104343/76, 46730/78, 130122/79, 12642/81, 16130/81, 16131/81 and 3819/78.

Of these compounds, yellow dye-releasing redox compounds are described in U.S. Pat. No. 4,013,633, Japanese Patent Application (OPI) Nos. 149328/78 and 114930/76, *Research Disclosure,* 17630 (1978) and 16475 (1977), etc.

Magenta dye-releasing redox compounds are described in U.S. Pat. Nos. 3,954,476, 3,931,144 and 3,932,308, Japanese Patent Application (OPI) Nos. 23628/78, 106727/77, 161332/79, 4028/80, 36804/80, 134850/80, and 65034/79, West German Patent Application (OLS) Ser. No. 2,847,371, etc.

Cyan dye-releasing redox compounds are described in U.S. Pat. Nos. 3,942,987, 3,929,760, 4,013,635, Japanese Patent Application (OPI) Ser. Nos. 109928/76, 149328/78, 8827/77, 143323/78, 47823/78, etc.

Redox compounds which release a dye by the ring-closure of a compound not oxidized, etc., are described in U.S. Pat. Nos. 4,139,379 and 3,980,479, West German Patent Application (OLS) Nos. 2,402,900 and 2,448,811, etc.

Dye developing agents which can be used are described in U.S. Pat. No. 2,983,606 and S. M. Bloom, M. Geen, M. Idelson & M. S. Simon, *The Chemistry of Synthetic Dyes,* Vol. 8, pages 331 to 387, K. Venkataraman Academic Press, New York (1978).

Any silver halide developing agent can be used so long as it can cross-oxidize a dye-releasing redox compound. Such silver halide developing agents may be incorporated either into an alkaline processing solution or into a suitable layer of the photographic element.

Examples of developing agents which can be used in this invention are hydroquinones, aminophenols, phenylenediamines, pyrazolidinones (e.g., phenidone, 1-phenyl-3-pyrazolidinone, dimethone(1-phenyl-4,4-dimethyl-3-pyrazolidinone), 1-p-tolyl-4-methyl-4-oxymethyl-3-pyrazolidinone, 1-(4'-methoxyphenyl)-4-methyl-4-oxymethyl-3-pyrazolidinone, and 1-phenyl-4-methyl-4-oxymethyl-3-pyrazolidinone, etc. which are described in Japanese Patent Application (OPI) No. 16131/81.

Of these compounds, black-and-white developing agents capable of reducing, in general, the formation of stains in the image-receiving layer (in particular, pyrazolidinones) are more preferred than color developing agents, such as phenylenediamines.

The processing solution as used herein contains a base, such as sodium hydroxide, potassium hydroxide, sodium carbonate, and sodium phosphate, and has an alkaline strength of pH 9 or more, preferably pH 11.5 or more. The processing solution can contain an anti-oxidant, such as sodium sulfite, ascorbic acid salt, and piperidinohexose reductone, and a silver ion concentration controlling agent, such as potassium bromide. Furthermore, it may contain a viscosity-increasing compound, such as hydroxyethyl cellulose, and sodium carboxymethyl cellulose.

The present alkaline processing solution may contain therein a compound to accelerate development or dispersion of dye, such as benzyl alcohol.

A light-sensitive element for providing the photographic print of this invention comprises a combination of a silver halide emulsion and a dye image-forming compound. For reproduction of natural color by the subtractive process, a light-sensitive element comprising at least two combinations of an emulsion having selective spectral sensitivity in a certain wavelength range and a dye image-forming compound having selective spectral absorption in the same wavelength range as the emulsion is used.

Between the intermediate layer and the layer containing a dye image-forming compound may be provided a partition layer as described in Japanese Patent Application (OPI) No. 52056/80.

A neutralizing layer, a neutralization rate controlling layer (timing layer) and a processing composition, used in the photographic print of this invention are described in, for example, Japanese Patent Application (OPI) No. 64533/77.

The following Examples are given to illustrate this invention in greater detail although this invention is not limited thereto.

EXAMPLE 1

Image-Receiving Sheet (A) was prepared by providing Layers (1), (2) and (3) shown below on a transparent polyethylene terephthalate support in that sequence.

Layer (1): A mordant layer containing 3.0 g/m$^2$ of a homopolymer mordant comprising a repeating unit shown below and 3.0 g/m$^2$ of gelatin.

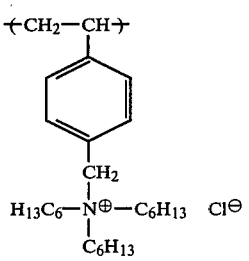

(viscosity: 136 cps as a 25 wt% ethanol solution)

Layer (2): A white reflection layer containing 17.6 g/m$^2$ of titanium oxide (R 780 produced by Ishihara Sangyo Kaisha Ltd., rutile type, treated with alumina and silica) and 2.5 g/m$^2$ of gelatin.

Layer (3): A layer containing 8 g/m$^2$ of gelatin.

Additionally, Image-Receiving Sheets (B) to (G) were prepared in the same manner as above except that the compounds shown below were added to the white reflection layer.

| Image-Receiving Sheet | Compound | Amount (g/m$^2$) |
|---|---|---|
| (B) | Compound (1) | 0.6 |
| (C) | Compound (3) | " |
| (D) | Compound (9) | " |
| (E) | Compound (15) | " |
| (F) | Compound (20) | " |
| (G-1) | tert-Butylhydroxy Anisole | " |
| (G-2) | 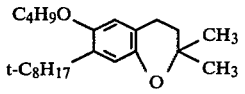 | " |

In providing the white reflection layer containing the compound shown above, the compound was dissolved in an equal amount of diethyllaurylamide. The solution obtained was emulsified and dispersed in a titanium oxide dispersion, and the resulting dispersion was coated.

Image-Receiving Sheets (A) to (G) were dyed with a cyan dye shown below so that the reflection density was 1.5, and irradiated for 7 days by the use of a 17,000 lux fluorescent lamp. Thereafter, the reflection density of the dye was measured. The results are shown in Table 1. The residual ratio of the dye is expressed by the ratio of reflection density after irradiation to initial reflection density (1.5).

Cyan Dye

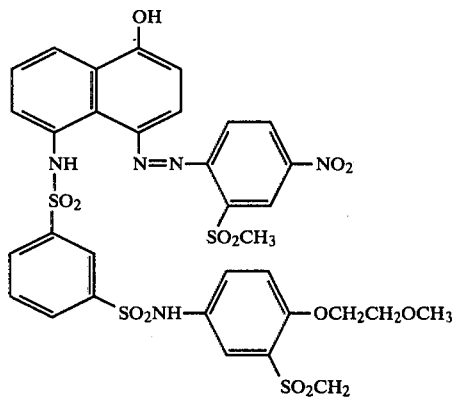

TABLE 1

| Image-Receiving Sheet | Dye Residual Ratio (%) |
|---|---|
| A (control) | 39 |
| B (this invention) | 78 |
| C (this invention) | 87 |
| D (this invention) | 91 |
| E (this invention) | 78 |
| F (this invention) | 79 |
| G-1 (comparison) | 45 |
| G-2 (comparison) | 65 |

As can be seen from Table 1, the light-resistance of the dye image formed in accordance with this invention is greatly increased.

Additionally, the foregoing image-receiving sheets dyed with the cyan dye were irradiated for 7 days by the use of a 17,000 lux fluorescent lamp and then allowed to stand for 5 days under the conditions of 50° C. and 80% humidity. The image-receiving sheets of this invention showed no coloration. However, the comparative image-receiving sheets showed yellow-brown coloration. This means that with the comparative image-receiving sheets, the white area of the photographic print is significantly stained.

Image-Receiving Sheet (G-3) was prepared in the same manner as used in preparing Image-Receiving Sheet (A) except that an ethanol solution of Compound (3) of this invention was added to the coating solution for the preparation of Layer (1) so that the amount of Compound (3) coated was 0.6 g/m$^2$. Image-Receiving Sheet (G-3) was processed and subjected to the light-resistance testing in the same manner as described above. The results are shown in Table 2.

TABLE 2

| Image-Receiving Sheet | Dye Residual Ratio (%) |
|---|---|
| C (this invention) | 87 |
| G-3 (comparison) | 53 |

From the results shown in Table 2, it can be seen that greatly improved light-resistance is obtained by adding the compound of this invention to the white reflection layer. These results are unexpectedly superior to results obtained by adding the compound of this invention to the mordant layer.

EXAMPLE 2

Image-Receiving Sheets (H) to (J) were prepared by providing Layers (1), (2) and (3) shown below on a transparent polyethylene terephthalate support in that sequence.

Layer (1): The same mordant layer as used in Example 1.

Layer (2): A white reflection layer containing 20.0 g/m$^2$ of titanium oxide and 2.86 g/m$^2$ of gelatin, or a white reflection layer containing 20.0 g/m$^2$ of titanium oxide, 2.86 g/m$^2$ of gelatin and 0.6 g/m$^2$ of Compound (9) of this invention. As the titanium oxide, the following were used:

| Image-Receiving Sheet | Titanium Oxide | | | | Presence of Compound (9) |
|---|---|---|---|---|---|
| | Type | Manufacturer | Crystalline Form | Surface Treatment | |
| H-1 | A-100 | Ishihara Sangyo Kaisha Ltd. | Anatase | None | No |
| H-2 | A-100 | Ishihara Sangyo Kaisha Ltd. | Anatase | None | Yes |
| I-1 | R-310 | Sakai Kagaku Co., Ltd. | Rutile | None | No |
| I-2 | R-310 | Sakai Kagaku Co., Ltd. | Rutile | None | Yes |
| J-1 | R-850 | Ishihara Sangyo Kaisha Ltd. | Rutile | $SiO_2$, $Al_2O_3$ | No |
| J-2 | R-850 | Ishihara Sangyo Kaisha Ltd. | Rutile | $SiO_2$, $Al_2O_3$ | Yes |

Layer (3): A layer containing 8.0 g/m$^2$ of gelatin.

The thus-prepared image-receiving sheets were dyed in the same manner as in Example 1 and were subjected to the same light-resistance testing as in Example 1 (17,000 lux fluorescent lamp, irradiation for 7 days). The results are shown in Table 3.

TABLE 3

| Image-Receiving Sheet | Dye Residual Ratio (%) |
|---|---|
| H-1 (control) | 31 |
| H-2 (this invention) | 79 |
| I-1 (control) | 34 |
| I-2 (this invention) | 82 |
| J-1 (control) | 42 |
| J-2 (this invention) | 93 |

From the results shown in Table 3, it can be seen that the light-resistance of this invention is demonstrated irrespective of the type of titanium oxide.

EXAMPLE 3

On a transparent polyethylene terephthalate support were provided Layers (1) to (12) shown below in that sequence to prepare Light-Sensitive Sheet (I).

Layer (1): The same mordant layer as used in Example 1.

Layer (2): A white reflection layer containing 17.6 g/m$^2$ of titanium oxide (R 780, produce by Ishihara Sangyo Kaisha Ltd., rutile type, treated with alumina and silica), 2.5 g/m$^2$ of gelatin, and 0.6 g/m$^2$ of Compound (3) emulsified and dispersed using an equal amount of diethyllaurylamide.

Layer (3): A light-shielding layer containing 2.0 g/m$^2$ of carbon black and 1.0 g/m$^2$ of gelatin.

Layer (4): A layer containing a cyan dye-releasing redox compound shown below (0.50 g/m$^2$), diethyllaurylamide (0.25 g/m$^2$), and gelatin (1.14 g/m$^2$).

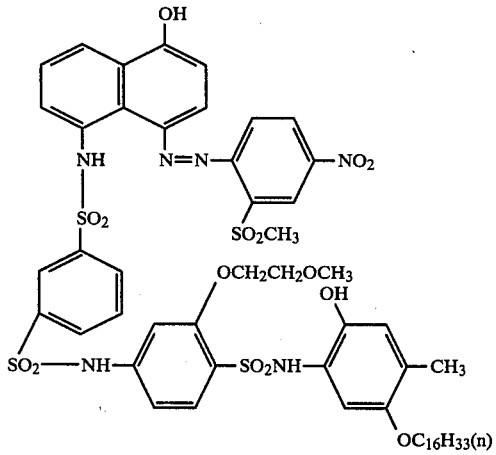

Layer (5): A layer containing a red-sensitive direct reversal silver iodobromide emulsion of the internal latent image type (halogen composition of silver halide: bromide: 2 mol%; as the amount of silver, 1.9 g/m$^2$; gelatin: 1.4 g/m$^2$), a nucleus-forming agent represented by the formula shown below (0.028 g/m$^2$), and sodium pentadecyl hydroquinone sulfonate (0.13 g/m$^2$).

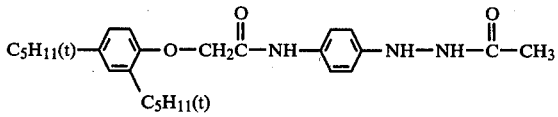

Layer (6): A layer containing gelatin (2.6 g/m$^2$) and 2,5-dioctylhydroquinone (1.0 g/m$^2$).

Layer (7): A layer containing a magenta dye-releasing redox compound represented by the formula shown below (0.45 g/m$^2$), diethyllaurylamide (0.10 g/m$^2$), 2,5-di-tert-butylhydroquinone (0.0074 g/m$^2$), and gelatin (0.76 g/m$^2$).

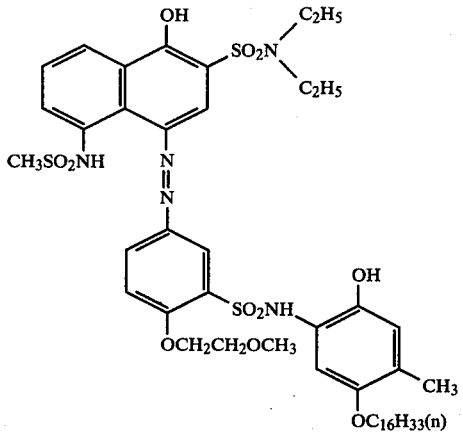

Layer (8): A layer containing a green-sensitive direct reversal silver iodobromide emulsion of the internal latent image type (halogen composition of silver iodobromide: iodine: 2 mol%; as the amount of silver, 1.4 g/m$^2$; gelatin: 1.0 g/m$^2$), the same nucleus-forming agent as used in Layer (5) (0.024 g/m$^2$), and sodium pentadecylhydroquinone sulfonate (0.11 g/m$^2$).

Layer (9): A layer containing gelatin (2.6 g/m$^2$) and 2,5-dioctylhydroquinone (1.0 g/m$^2$).

Layer (10): A layer containing Yellow Dye-Releasing Redox Compounds (I) (0.45 g/m$^2$) and (II) (0.55 g/m$^2$) shown below, diethyllaurylamide (0.16 g/m$^2$), 2,5-di-tert-butylhydroquinone (0.012 g/m$^2$) and gelatin (0.78 g/m$^2$).

Yellow Dye-Releasing Redox Compound (I)

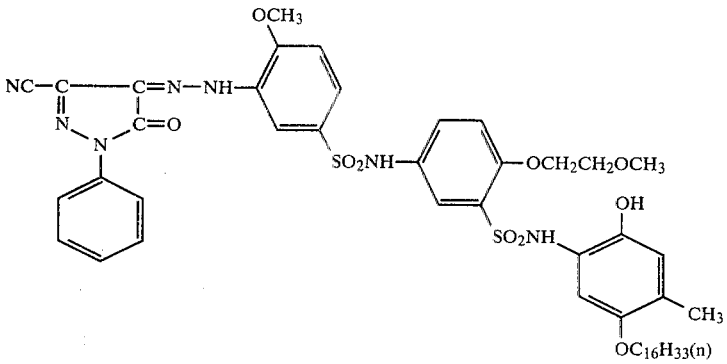

Yellow Dye-Releasing Redox Compound (II)

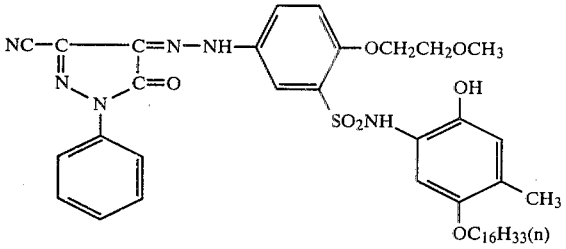

Layer (11): A layer containing a blue-sensitive direct reversal silver iodobromide emulsion of the internal latent image type (halogen composition of silver iodobromide: iodine: 2 mol%; as the amount of silver, 2.2 g/m$^2$; gelatin: 1.7 g/m$^2$), the same nucleus-forming agent as used in Layer (5) (0.020 g/m$^2$), and sodium pentadecylhydroquinone sulfonate (0.094 g/m$^2$).

Layer (12): A layer containing gelatin (0.94 g/m$^2$).

Additionally, Light-Sensitive Sheet (II) was prepared in the same manner as above except that a layer comprising 17.6 g/m$^2$ of titanium oxide and 2.5 g/m$^2$ of gelatin was used in place of Layer (2) of Light-Sensitive Sheet (I). Furthermore, Light-Sensitive Sheet (III) was prepared in the same manner as used in preparing Light-Sensitive Sheet (I) except that a white reflection layer comprising 17.6 g/m$^2$ of titanium oxide, 2.5 g/m$^2$ of gelatin, and 0.6 g/m$^2$ of 2,2'-butylidene-bis(6-tert-butyl-4-methylphenol), and furthermore diethyllaurylamide in the same amount as the 2,2'-butylidene-bis(6-tert-butyl-4-methylphenol) was used in place of Layer (2) of Light-Sensitive Sheet (I).

COVER SHEET

On a polyethylene terephthalate support was coated 15 g/m$^2$ of polyacrylic acid (viscosity: about 1,000 cps as a 10% by weight aqueous solution) to form an acidic polymer layer, on which were coated 3.8 g/m$^2$ of acetyl cellulose (forming 39.4 g of an acetyl group on hydrolysis of 100 g of acetyl cellulose) and 0.2 g/m$^2$ of a styrene-maleic anhydride copolymer (ratio of styrene to maleic anhydride: about 60/40; molecular weight: about 50,000) as a neutralizing timing layer to prepare a cover sheet.

PROCESSING STEPS

The foregoing cover sheet was superposed on each of Light-Sensitive Sheets (I), (II) and (III). The sheets were then exposed to white light from the side of the cover sheet. Thereafter, a processing solution having the formulation shown below was extended between the sheets in a thickness of 85$\mu$ by the use of a press-roll. This processing was performed at 25° C.

| Processing Solution | |
|---|---|
| 1-Phenyl-4-methyl-4-hydroxymethyl-3-pyrazolidinone | 10 g |
| Methylhydroquinone | 0.18 g |
| 5-Methylbenzotriazole | 4.0 g |
| Sodium Sulfite (anhydrous) | 1.0 g |
| Carboxymethyl Cellulose Sodium Salt | 40.0 g |
| Carbon Black | 150 g |
| Potassium Hydroxide (28% aq. soln.) | 200 ml |
| Water | 550 ml |

After the processing was completed, the resulting photographic print (two sheets were firmly superposed) was dried by allowing to stand for 2 weeks at 35° C. and 10% RH.

The thus-obtained photographic print was irradiated for 3 months by the use of a 500 lux fluorescent lamp, and a reduction in density of the area whose initial density was 1.5 was measured.

With each of magenta and cyan, the residual ratio is shown in Table 4.

TABLE 4

| Light-Sensitive Sheet | Dye Residual Ratio Cyan (%) | Magenta (%) |
|---|---|---|
| (I) (this invention) | 88 | 94 |
| (II) (control) | 39 | 42 |
| (III) (comparison) | 55 | 70 |

From the results shown in Table 4, it can be seen that the photographic print of this invention has excellent long term light-resistance at low illumination.

Light-Sensitive Sheet (IV) was prepared by the same method as used in preparing Light-Sensitive Sheet (I) except that Layer (1) further contained 0.6 g/m$^2$ of Compound (3) of this invention and an equal amount of diethyllaurylamide, and that Layer (2) did not contain Compound (3) and diethyllaurylamide. This Light-Sensitive Sheet (IV) and the same cover as used above were superposed and exposed, and then a processing solution was introduced therebetween. After the processing was performed for 60 minutes, the maximum density of the transferred color image was measured by the use of a Macbeth densitometer (Model RD-519).

The results are shown in Table 5.

TABLE 5

| Light-Sensitive Sheet | $D^B$ max | $D^G$ max |
|---|---|---|
| (I) (this invention) | 1.92 | 2.01 |
| (IV) (comparison) | 1.77 | 1.94 |

The blue density and green density were lower by 0.15 and 0.07, respectively, below those obtained using Light-Sensitive Sheet (I).

It can thus be seen that addition of the compound of this invention to the mordant layer markedly deteriorates photographic characteristics.

While the invention has been described in detail and with reference to specific embodiments thereof, it will be apparent to one skilled in the art that various changes and modifications can be made therein without departing from the spirit and scope thereof.

What is claimed is:

1. A photographic print prepared by a color diffusion transfer process comprising a support, a mordant layer containing therein a diffusion transfer dye image, and a white reflection layer constituting a background of the dye image, wherein the white reflection layer contains a compound represented by formula (I):

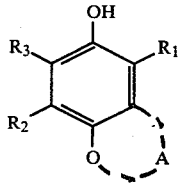

(I)

wherein $R_1$, $R_2$ and $R_3$ may be the same or different and each represents a hydrogen atom, a halogen atom, an alkyl group, an aryl group, an aralkyl group, an alkoxy group, an aryloxy group, an aralkyloxy group, an alkenyl group, an alkenyloxy group, an alkylthio group, an arylthio group, an acyl group, an acylamino group, a diacylamino group, an alkylamino group, a sulfonamido group, an acyloxy group, an alkoxycarbonyl group or an aryloxycarbonyl group; and A represents a non-metallic atom group necessary for forming a 5- or 6-membered ring.

2. A photographic print as in claim 1, wherein said photographic print is of the integral type.

3. A photographic print as in claim 1, wherein said compound represented by formula (I) is a compound represented by formula (II):

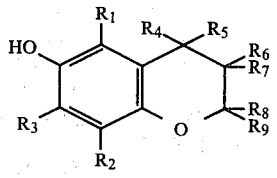

(II)

wherein $R_1$ to $R_3$ are the same as described for formula (I); and $R_4$ to $R_9$ may be the same or different and each represents a hydrogen atom, a halogen atom, a branched-chain, straight-chain or cyclic alkyl group containing 1 to 20 carbon atoms, a branched-chain, straight-chain or cyclic alkoxy group containing 1 to 20 carbon atoms, a branched-chain, straight-chain or cyclic alkylthio group containing 1 to 20 carbon atoms, an alkenyl group, an alkenyloxy group, an aryl group, an aryloxy group, an N-substituted amino group, or a heterocyclic ring group bonded through a carbon atom contained in the heterocyclic ring.

4. A photographic print as in claim 3, wherein $R_1$, $R_2$, and $R_4$ to $R_8$ are each a methyl group or a hydrogen atom.

5. A photographic print as claimed in any of claim 3 or 4, wherein the compound represented by formula (II) is a compound represented by the following formula:

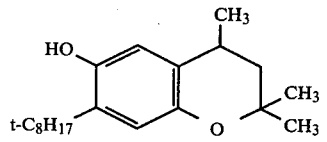

6. A photographic print as claimed in any of claim 3 or 4, wherein the compound represented by formula (II) is a compound represented by the following formula:

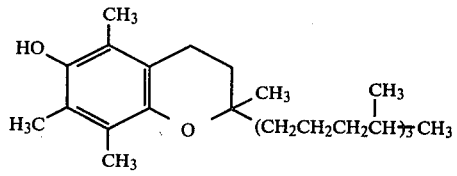

7. A photographic print as in claim 1, wherein the compound represented by formula (I) is a compound represented by formula (III):

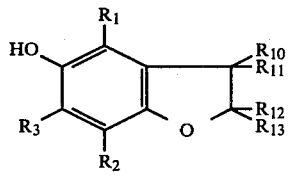

(III)

wherein $R_1$ to $R_3$ are the same as described for formula (I); and $R_{10}$ to $R_{13}$ may be the same or different and each represents a hydrogen atom, a halogen atom, a branched-chain, straight-chain or cyclic alkyl group containing 1 to 20 carbon atoms, a branched-chain, straight-chain or cyclic alkoxy group containing 1 to 20 carbon atoms, a branched-chain, straight-chain or cyclic alkylthio group containing 1 to 20 carbon atoms, an alkenyl group, an alkenyloxy group, an aryl group, an aryloxy group, an N-substituted amino group, or a heterocyclic ring group bonded through a carbon atom contained in the heterocyclic ring.

8. A photographic print as in claim 1, wherein a white pigment for use in the white reflection layer is titanium oxide.

9. A photographic print as in claim 8, wherein the titanium oxide is subjected to a surface-treatment using a compound selected from the group consisting of alumina, silica and zinc oxide.

10. A photographic print as in claim 8, wherein the titanium oxide is a rutile type titanium oxide.

11. A photographic print as in claim 1, wherein a binder for use in the white reflection layer is gelatin.

12. A photographic print as in claim 1, wherein a water-insoluble homo- or copolymer mordant for use in a photographic element for the color diffusion transfer process contains a repeating unit represented by the following formula:

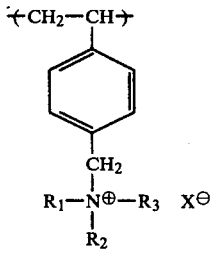

wherein $R_1$, $R_2$ and $R_3$ are each an alkyl group or a substituted alkyl group, and the total number of carbon atoms contained therein is 12 or more, and X is an anion.

13. A photographic print as in claim 1, wherein the white reflection layer is located and provided as a layer, prior to photographic development.

* * * * *